US012303046B2

(12) United States Patent
Goppion

(10) Patent No.: US 12,303,046 B2
(45) Date of Patent: May 20, 2025

(54) SELF-SUPPORTING MUSEUM DISPLAY CASE, RELATED CONSTRUCTION METHOD AND WALL UNIT

(71) Applicant: GOPPION S.P.A., Trezzano sul Naviglio (IT)

(72) Inventor: Alessandro Goppion, Milan (IT)

(73) Assignee: GOPPION S.P.A., Trezzano sul Naviglio (IT)

( * ) Notice: Subject to any disclaimer, the term of this patent is extended or adjusted under 35 U.S.C. 154(b) by 101 days.

(21) Appl. No.: 17/937,578

(22) Filed: Oct. 3, 2022

(65) Prior Publication Data

US 2023/0117697 A1 Apr. 20, 2023

(30) Foreign Application Priority Data

Oct. 18, 2021 (IT) ..... 102021000026702

(51) Int. Cl.
*A47F 3/00* (2006.01)

(52) U.S. Cl.
CPC ..... *A47F 3/004* (2013.01); *A47F 3/005* (2013.01)

(58) Field of Classification Search
CPC ..... A47F 3/004; A47F 3/005; A47F 3/0434; A47F 3/043; A47F 2003/008; A47F 3/12;
(Continued)

(56) References Cited

U.S. PATENT DOCUMENTS 1,640,870 A * 8/1927 Asplund ..... A47F 3/005 217/58
2,217,725 A * 10/1940 Bloomfield ..... A47F 3/005 312/114

(Continued)

FOREIGN PATENT DOCUMENTS

DE 19634322 A1 2/1998
DE 202011106103 U1 1/2012

(Continued)

OTHER PUBLICATIONS

Italian Search Report and Written Opinion issued for Italian Application No. IT 202100026702 filed on Oct. 18, 2021. Date of Completion of Search: May 24, 2022. 4 Pages. IT Original and Partial English Translation.

*Primary Examiner* — Hiwot E Tefera

(74) *Attorney, Agent, or Firm* — Steinfl + Bruno LLP

(57) ABSTRACT

A method for construction of a museum display case is presented. The museum display case has a platform and a case above the platform, the case having at least one opening door. The method includes: providing glass panes, applying first metal beams to the glass panes beforehand by gluing, forming wall units, providing second metal beams at the opening door, forming the case by assembling the wall units together by means of the first and second metal beams, so that the first and second metal beams form a load-bearing structure only when the wall units have been assembled, and fixing the load-bearing structure of the case to the platform. With this method, the load-bearing structure of the display case is not formed by a frame to which the fixed and opening walls are then applied, but by the first and second metal beams, the former being already pre-glued to the glass panes of the fixed walls of the display case. This method makes the assembly of the display case easier and faster.

5 Claims, 13 Drawing Sheets

(58) Field of Classification Search
CPC ..... A47F 3/125; A47F 3/0404; A47B 47/03; A47B 47/05; F16B 2012/446; F16B 12/50; F16B 11/006; F25D 23/063
See application file for complete search history.

(56) References Cited

U.S. PATENT DOCUMENTS 2,580,029 A * 12/1951 Krauss ..... A47F 3/005 220/668
2,765,886 A * 10/1956 Gross ..... A47B 47/0008 49/413
3,150,903 A * 9/1964 Chapman ..... F16B 12/02 217/65
3,228,736 A * 1/1966 Beckerman ..... F16B 12/02 220/668
3,598,464 A * 8/1971 Moroziuk ..... E06B 3/4663 312/223.5
3,736,035 A * 5/1973 Brown ..... A47B 97/001 403/375
3,998,509 A * 12/1976 Hauser ..... A47F 3/12 D6/661
4,126,364 A * 11/1978 Reilly ..... F16B 12/50 312/263
4,291,928 A * 9/1981 Kiyosawa ..... A47B 96/1416 211/187
4,953,362 A * 9/1990 Shoji ..... A47F 3/005 62/297
5,054,863 A * 10/1991 Amstutz ..... A47F 3/005 312/111
5,524,977 A * 6/1996 Orawski ..... A47F 3/005 312/265.5
6,398,322 B1 * 6/2002 Chaplin ..... A47F 3/12 312/140
2004/0075371 A1 * 4/2004 Latchinian ..... A47F 3/004 312/265.4
2007/0007865 A1 * 1/2007 Kang ..... A47F 3/005 312/114
2017/0290446 A1 * 10/2017 Goppion ..... A47F 3/12
2023/0355010 A1 * 11/2023 Kneeskern ..... A47F 3/005

FOREIGN PATENT DOCUMENTS

EP 2666391 A2 11/2013
EP 2666391 A3 1/2014
EP 3626986 A1 3/2020

* cited by examiner

SELF-SUPPORTING MUSEUM DISPLAY CASE, RELATED CONSTRUCTION METHOD AND WALL UNIT

CROSS-REFERENCE TO RELATED APPLICATIONS

The present application claims priority to Italian Patent Application No. 102021000026702 filed on Oct. 18, 2021, the contents of which are incorporated herein by reference in their entirety.

FIELD

The present disclosure relates to a method for constructing a museum display case, a museum display case constructed according to such a method and a wall unit used in such a method.

BACKGROUND

A museum display case is a display case intended to be placed in an exhibition environment such as a museum, exhibition or the like and intended for the conservation and display in a protected environment of cultural heritage assets, such as works of art, historical artefacts and the like. The term display case alone will be used below for the sake of brevity, although it still means a museum display case.

A protected environment is defined as an environment to which access by unauthorised personnel is prevented, in order to avoid theft of and damage of the displayed objects; it is also possible for the atmosphere in such an environment to be controlled, through the monitoring of one or more parameters including temperature, humidity, dust content, pollutant content, in order to maintain the intended conservation conditions of the exhibits.

This type of display case must therefore meet various requirements, in relation to conservation and integrity of the objects displayed. Furthermore, these display cases must of course ensure the best visibility for the objects displayed.

In order to improve visibility, display case manufacturers try as far as possible to use transparent materials—typically glass—for the walls of the display cases. In addition to ensuring the best visibility of the objects displayed, the extensive use of glass is often desired by display case designers because the transparency of the material makes it possible to give maximum prominence to the objects displayed.

Thus, display cases have been developed with a platform surmounted by a case made of panels; the platform houses the technical components necessary to ensure that the environment inside the case is protected and is therefore normally enclosed by non-transparent walls, which conceal the technical components from view; conversely, the case walls are made entirely or largely of glass, to ensure visibility; the glass walls of the case are mounted on a metal load-bearing frame supported by the platform.

The possibility of access inside the case, for the storage, removal or maintenance of the objects displayed, is normally achieved by having one of the side walls openable. To this end, various types of opening supports are used, by means of which the opening wall is mounted on the load-bearing frame of the case; these supports can allow opening by rotation or rototranslation of the panel (and are therefore in practice more or less complex hinges) or by sliding (and are therefore in practice sliding guides).

The construction of the display case normally starts with the load-bearing frame, which must be particularly solid in order to be able to safely support the weight of all the glass walls that will be fixed thereto; this weight can be very high, for example when the display case is very large and/or has glass walls with a layered structure with a high thickness to provide a high degree of protection (such as bullet-proof glass). Once the load-bearing frame has been set up, the glass walls are applied thereto, normally by gluing, so as to minimise visual impact.

In recent times, manufacturers have tried to improve glass construction techniques, rationalising them so as to maintain the high-quality standards demanded by users while reducing construction time and costs. It should also be borne in mind that in many cases this type of display case must be assembled on site, because their size does not make it possible or convenient to transport them in an assembled condition.

SUMMARY

The embodiments of the present disclosure are directed at facilitating and rationalising the construction of a museum display case, in particular a museum display case comprising a platform and a case above the platform, in which the case has at least one opening door.

These embodiments include a method, a display case and a wall unit as claimed.

More in particular, the method comprises:

providing glass panes, applying first metal beams to the glass panes beforehand by gluing, forming wall units, providing second metal beams at the opening door, forming the case by assembling the wall units together by means of the first and second metal beams, so that the first and second metal beams form a load-bearing structure only when the wall units have been assembled, fixing the load-bearing structure of the case to the platform.

Thereby, the load-bearing structure of the display case is not formed by a frame to which the fixed and opening walls are then applied, but by the first and second metal beams, the former being already pre-glued to the glass panes of the fixed walls of the display case. This method makes it easier and faster to assemble the display case, thus reducing the costs thereof. This advantage is particularly evident when the assembly of the display case is to be carried out at the installation site; the gluing between the glass panes and the first metal beams can be conveniently done at the factory, transporting the glass panes already glued to the first metal beams, while no gluing is required at the installation site. The simplicity afforded by this method therefore allows for both faster assembly and the employment of non-specialised personnel, thus enabling a reduction in costs without compromising the quality of the display case.

Preferably, the first metal beams are fixed to the glass panes near or at the sides thereof, more preferably the lower and upper sides thereof. Thereby, the load-bearing structure formed by the first and second metal beams is located at the corners of the display case, and is therefore hardly visible.

Preferably, the first and second metal beams are assembled together by means of corner joints.

Preferably, the method comprises:

providing an additional glass pane to form the opening door, mounting the additional glass pane of the opening door in the display case by means of opening mounting mechanisms, fixed on one side to the load-bearing structure of the case and on the other side to the additional glass pane of the opening door.

The opening mounting mechanisms can be more or less complex hinges, sliding systems or other known systems, and can be fixed to the first or second metal beams or to the corner joints.

In a second aspect, the present disclosure includes a museum display case constructed according to the aforesaid method, comprising wall units each consisting of a glass pane and first metal beams glued to the glass pane at the lower and upper sides thereof.

In this display case, the gluing of the first metal beams to the glass panes can be advantageously performed in the factory, while the subsequent assembly of the wall units does not require gluing and can therefore be done easily at the time and place of installation.

Preferably, the museum display case comprises corner joints by means of which adjacent wall units are assembled together, where the corner joints are fixed to the first and/or second metal beams.

In a preferred embodiment, the first and second metal beams are tubular and the corner joints are formed by L-shaped elements inserted into the ends of the first and second metal beams. This coupling, which in practice provides for a form fit between corner joints and tubular beams, ensures excellent assembly strength.

Preferably, to further improve the assembly strength, screws are provided, engaged between the corner joints and the first and second metal beams.

In another preferred embodiment, the corner joints are formed by cube-shaped elements, fixed to the first and/or second metal beams by means of fixing screws. Cube-shaped elements are understood here and hereafter to mean elements with a compact parallelepiped shape, for example, but not necessarily, cubic.

Preferably, the cube-shaped corner joints comprise through holes for the fixing screws and the first and second metal beams comprise a face glued to the glass pane and a free face on which at least one open longitudinal channel is formed, adapted to receive threaded nuts in screwing engagement with the fixing screws, in any longitudinal position of the channel.

This coupling allows great freedom of adjustment, facilitating the assembly operations of the display case.

To further improve ease of assembly, the through holes preferably have a slotted cross-section.

Preferably, threaded through-holes in the cube-shaped corner joints and adjusting screws in engagement in threaded through-holes are also provided, where the adjusting screws pointedly abut against the first and second metal beams. Thereby, a very precise adjustment of the position of the wall units in relation to each other is possible, thus ensuring a perfect assembly of the display case even in the presence of unavoidable, even significant dimensional tolerances in the individual elements that compose it.

Preferably, two of the through holes and two of the threaded through holes are provided between each pair of opposite faces of the cube-shaped corner joints. Thereby, the corner joints can be used in any position.

In a further aspect, the present disclosure relates to a wall unit for making a museum display case according to the method set out above, and comprises a glass pane and first metal beams glued to the glass pane at the lower and upper sides thereof.

BRIEF DESCRIPTION OF THE DRAWINGS

Further features and advantages of the embodiments of the present disclosure will be more evident from the following description of preferred embodiments thereof made with reference to the appended drawings.

In such drawings.

DETAILED DESCRIPTION

Figure 1:
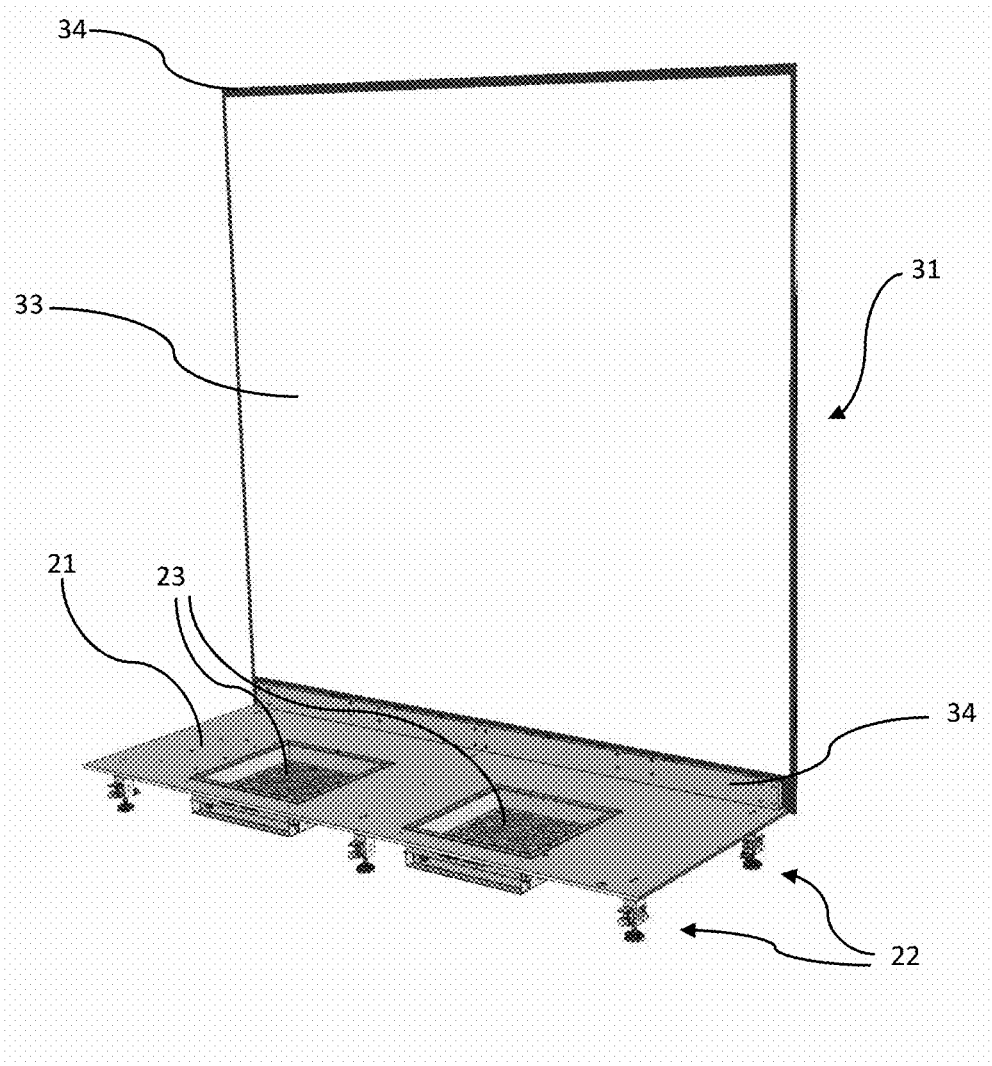
FIGS. 1 to 5 show in perspective view and in a schematic manner some successive steps of the construction of the display case according to an embodiment of the present disclosure.

In FIGS. 1 to 13, 10 indicates a display case as a whole according to the present disclosure. The display case 10 comprises a platform 20 surmounted by a case 30. The platform 20 comprises a plane 21 mounted on feet 22. The case 30 comprises three fixed side walls, all indicated with 31, an opening door 41, and a ceiling 32.

The platform 20 comprises a technical compartment 23, for example a drawer for storing hygroscopic material, such as silica gel or the like. The feet 22 (see FIGS. 11 and 12) each comprise a body 24 fixed below the plane 21; a tip 25, for contact with the floor on which the display case 10 is placed, is fixed to the body 24 in an adjustable manner (e.g., by means of a threaded coupling). First brackets 26 and second brackets 27 are also fixed (by screws, not shown) to the body 24. The first brackets 26 serve for anchoring to the floor, while the second brackets 27 serve for supporting a plinth 28 that closes the space below the floor 21 downwards; the plinth 28 is made of ferrous material and is anchored to each second bracket 27 of the feet 22 by means of a magnet 29, which is fixed to the second bracket 27.

The fixed side walls 31 each comprise a glass pane 33 to which two first metal beams 34, arranged horizontally at the upper and lower edges of the glass pane 33, are stably applied by means of gluing. The set of the glass pane 33 and the two first metal beams 34 glued thereto form a wall unit, hereafter referred to by the same reference 31 as the fixed side wall. The first metal beams 34 have a tubular structure, with a rounded rectangular cross-section.

Figure 2:
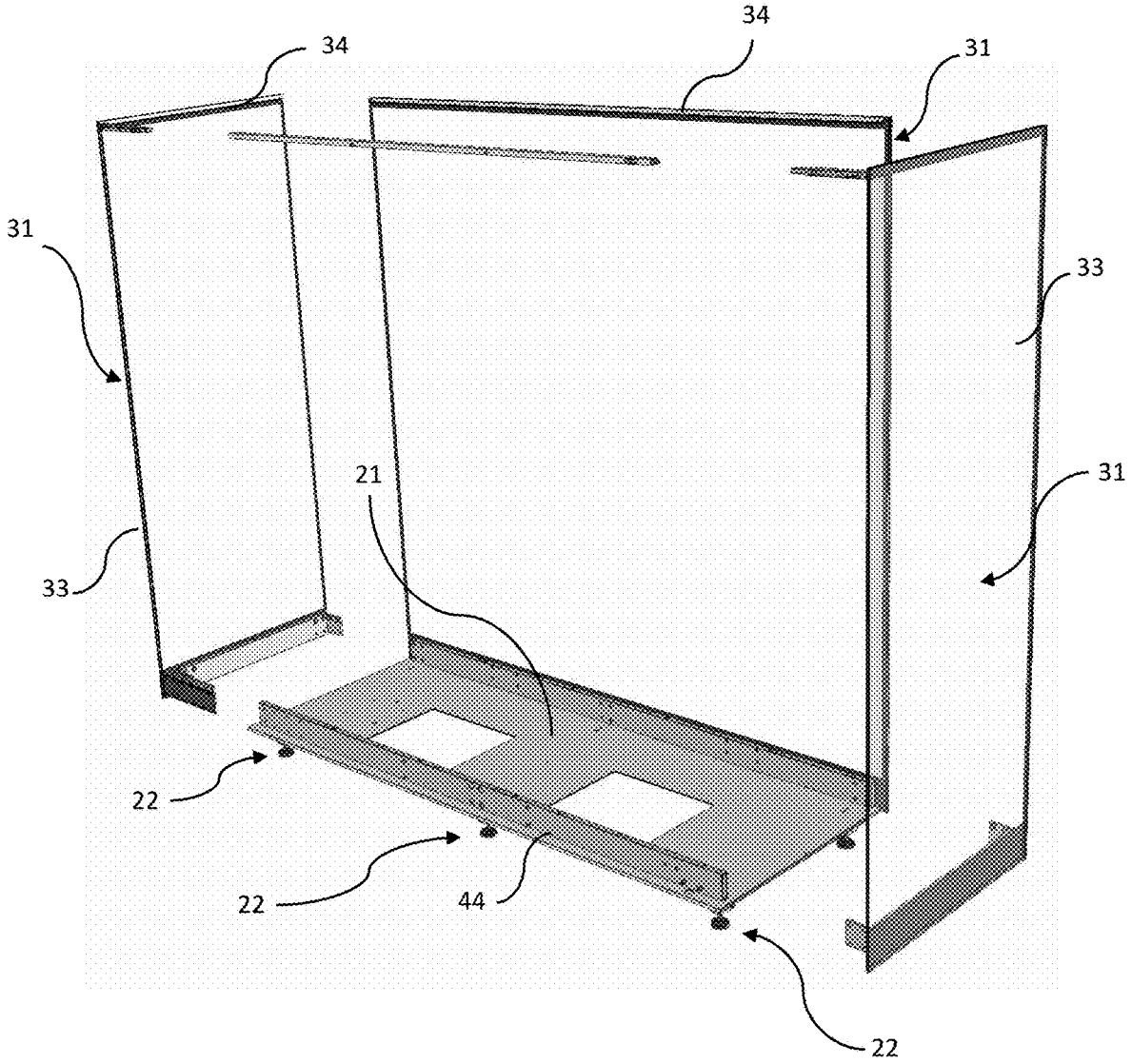
Figure 3:
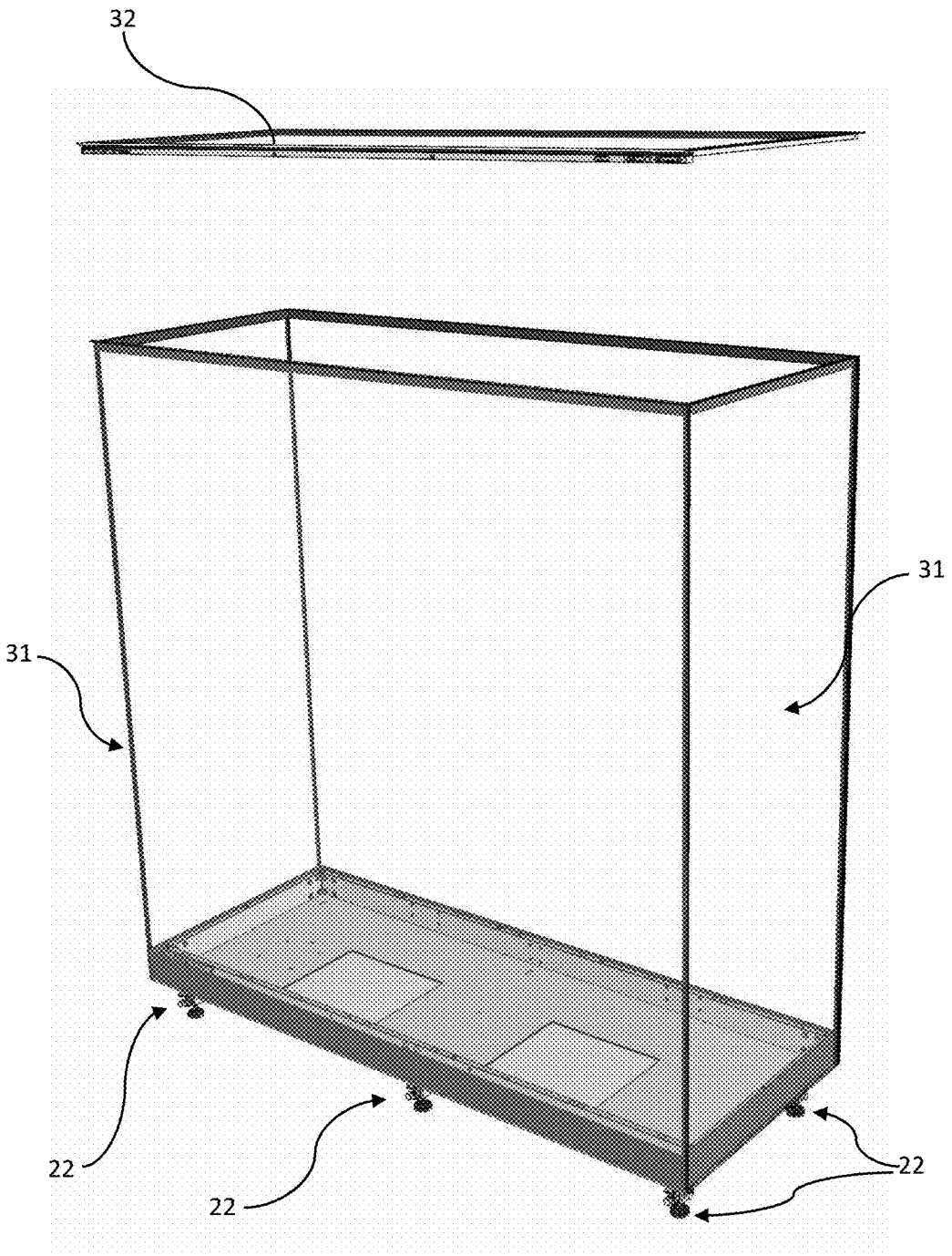
Figure 6:
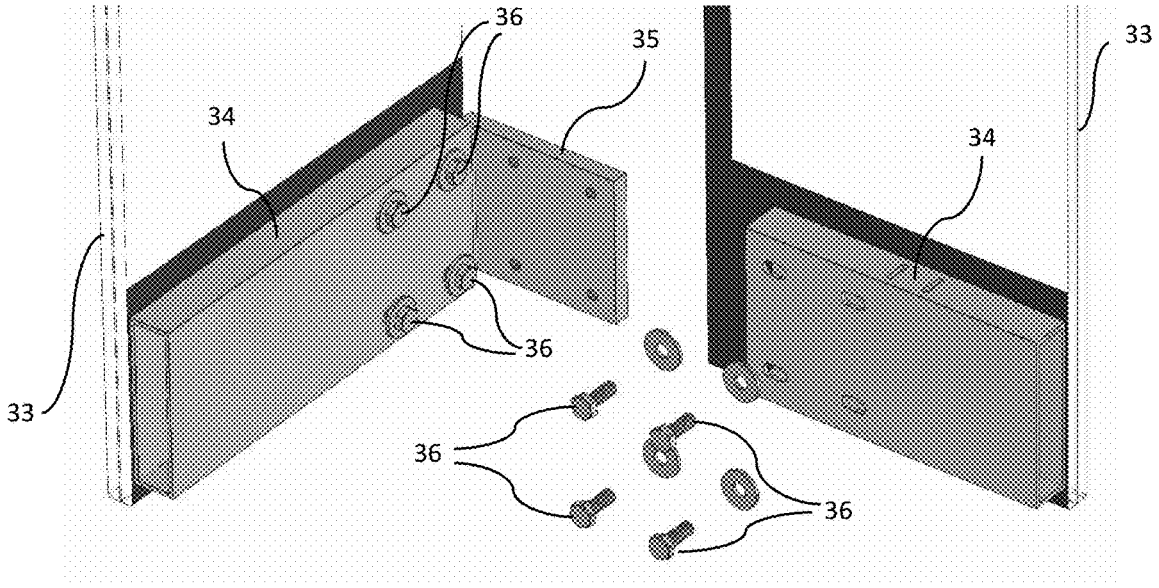
FIGS. 6 to 8 show a detail of the display case of FIG. 1 at a lower vertex, in successive steps of the construction of the display case.
Figure 7:
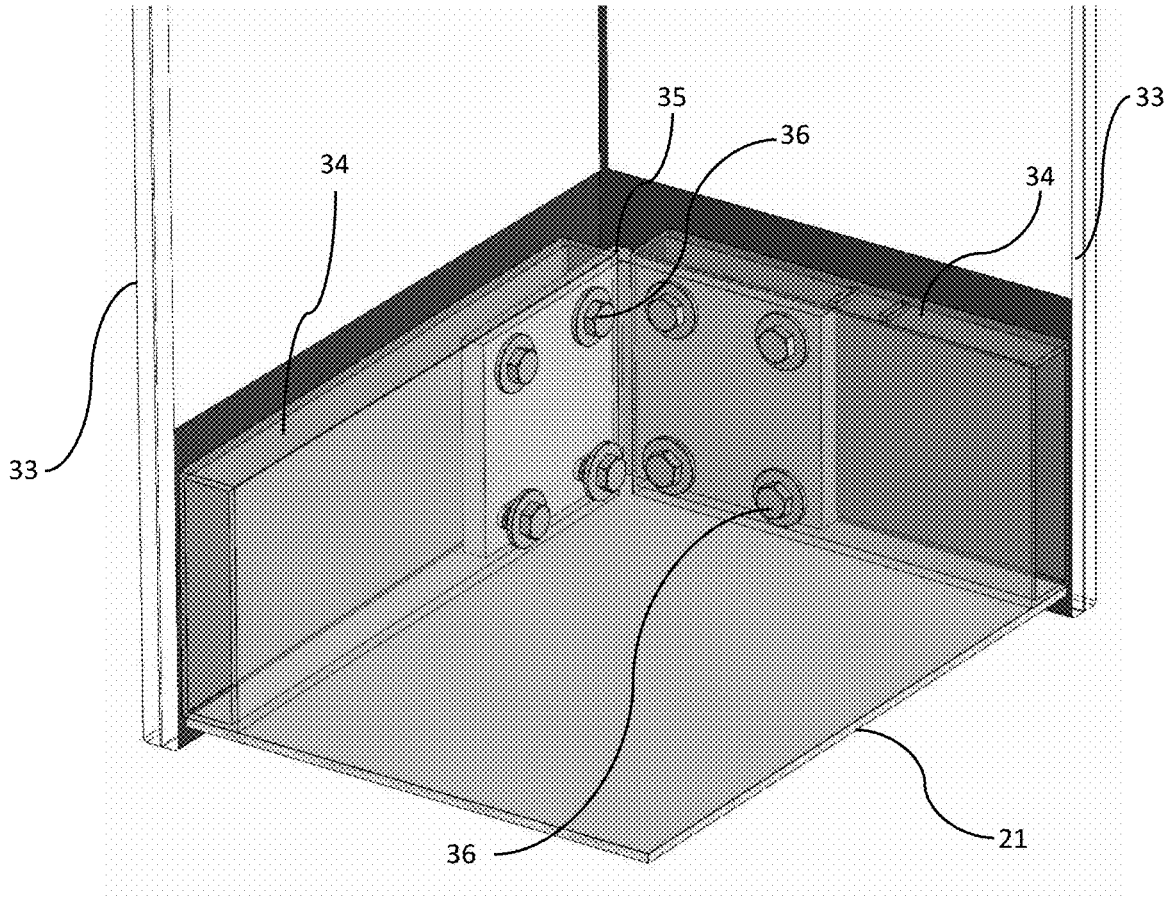
Figure 8:
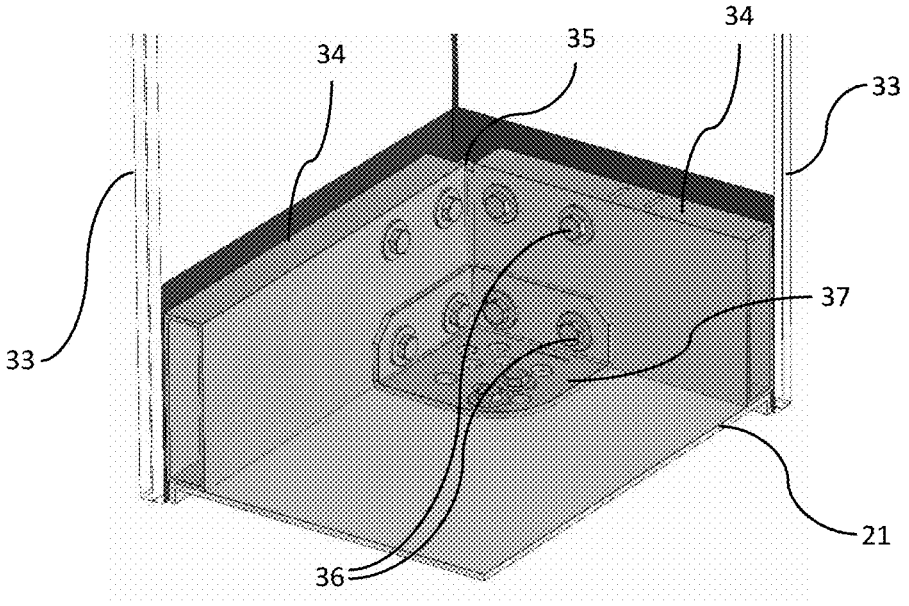

As can be seen above all in FIGS. 6, 7, 8, the wall units 31 are assembled with each other and with the plane 21 of the platform 20 at the vertices of display case 10; the aforesaid figures show the lower part of display case 10, but it must be understood that the same coupling that will now be described is also made in the upper part of display case 10, as summarily illustrated in FIG. 2.

More in particular, the display case 10 comprises corner joints 35 which are L-shaped, with two arms substantially orthogonal to each other, sized so as to insert into the first metal beams 34, preferably with a certain force; screws 36 ensure—together with the force—that the corner joints 35 are made integral with the first metal beams 34. Accordingly, the corner joints 35 ensure the constraint between adjacent wall units 31.

Figure 9:
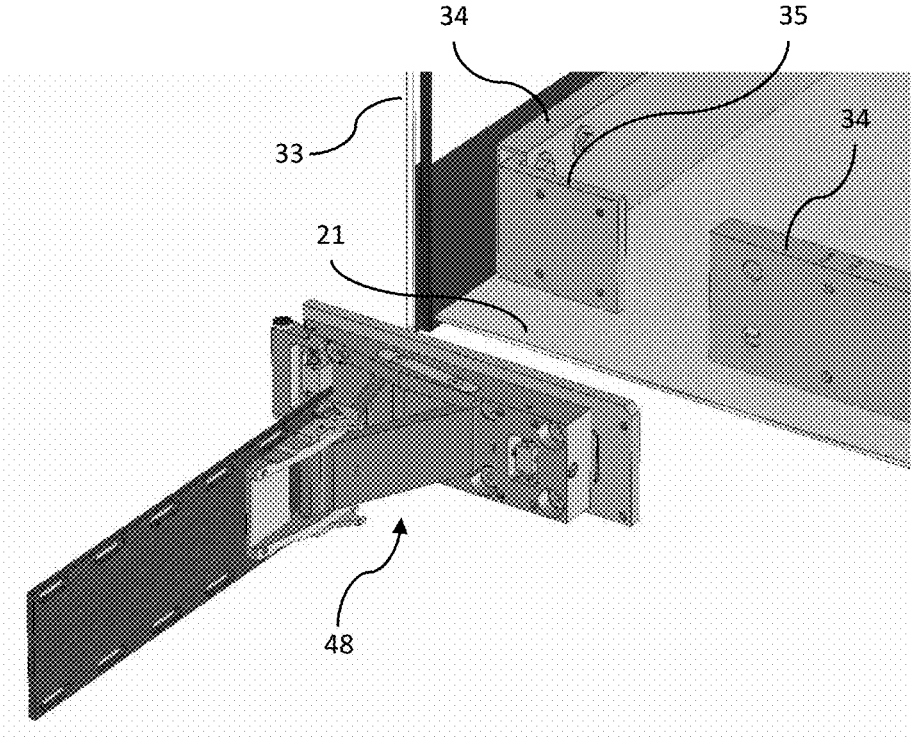
FIG. 9 shows a detail of the display case of FIG. 1 at an opening mounting mechanism, in particular a hinge.
Figure 10:
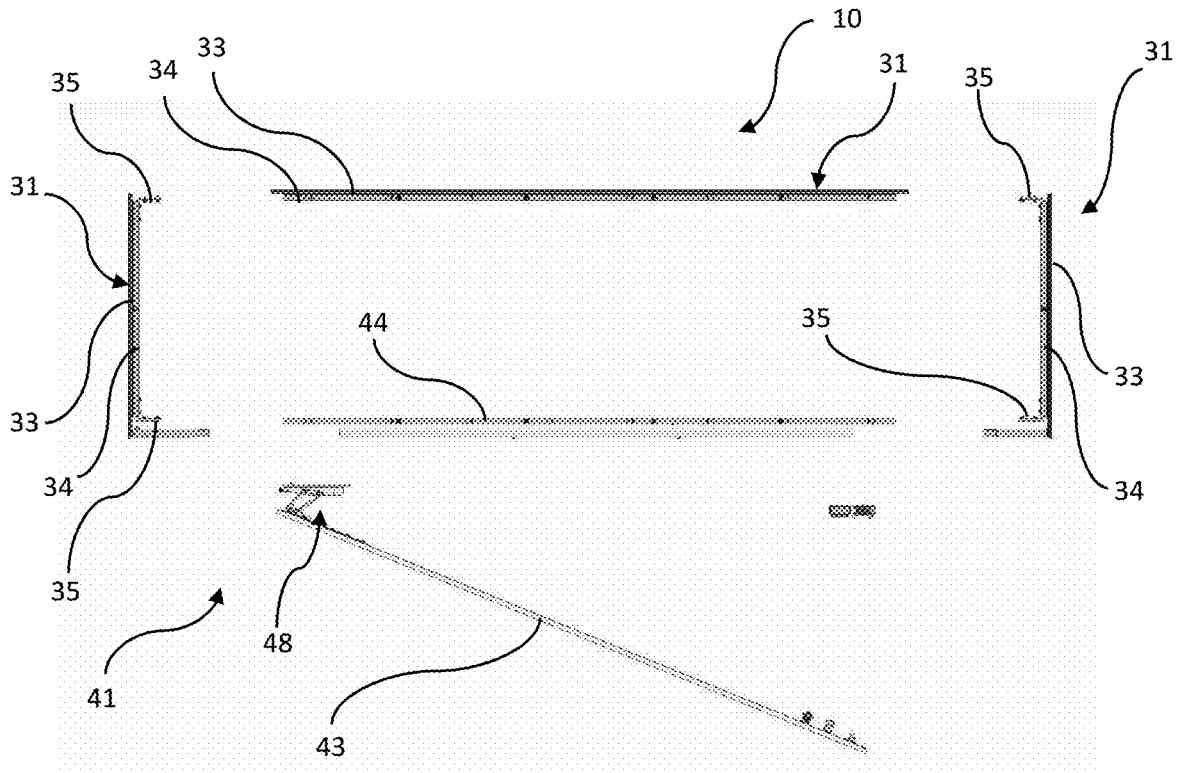
FIG. 10 shows in a schematic manner the mounting of the display case of FIG. 1.
Figure 11:
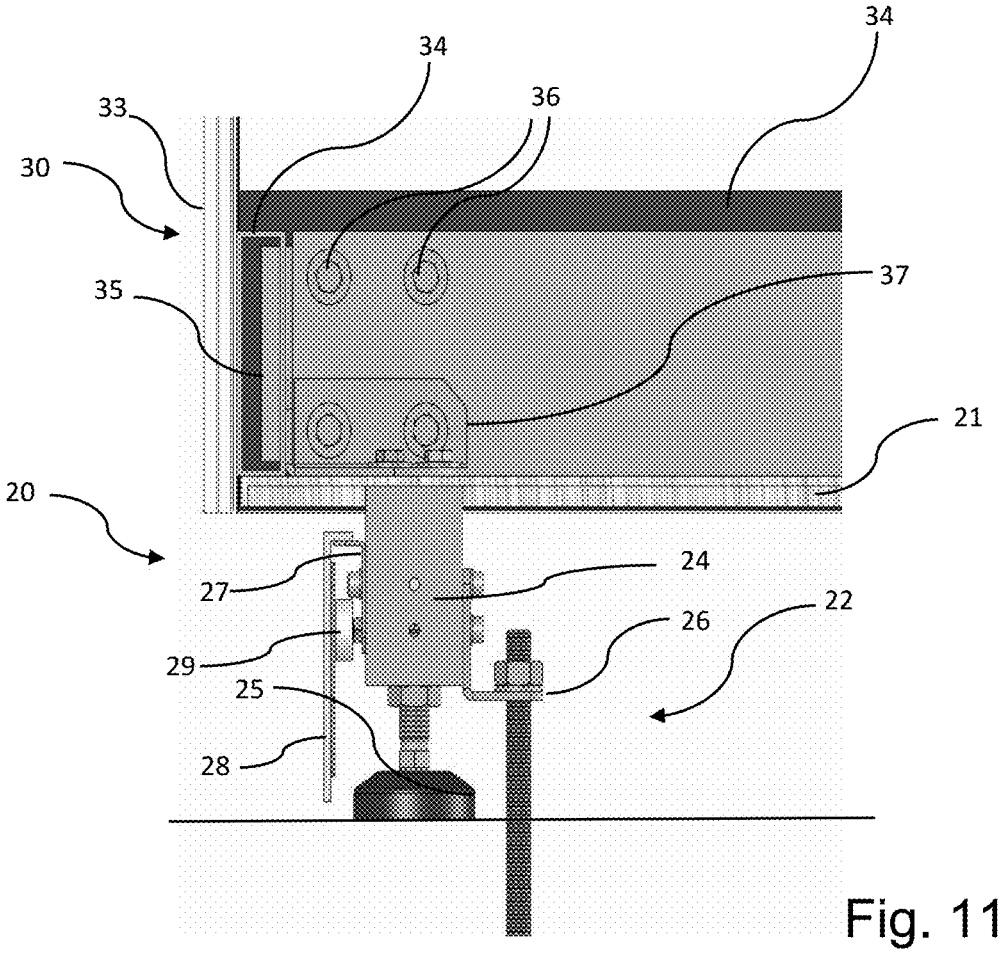
FIG. 11 shows a detail with a foot of the display case of FIG. 1.
Figure 12:
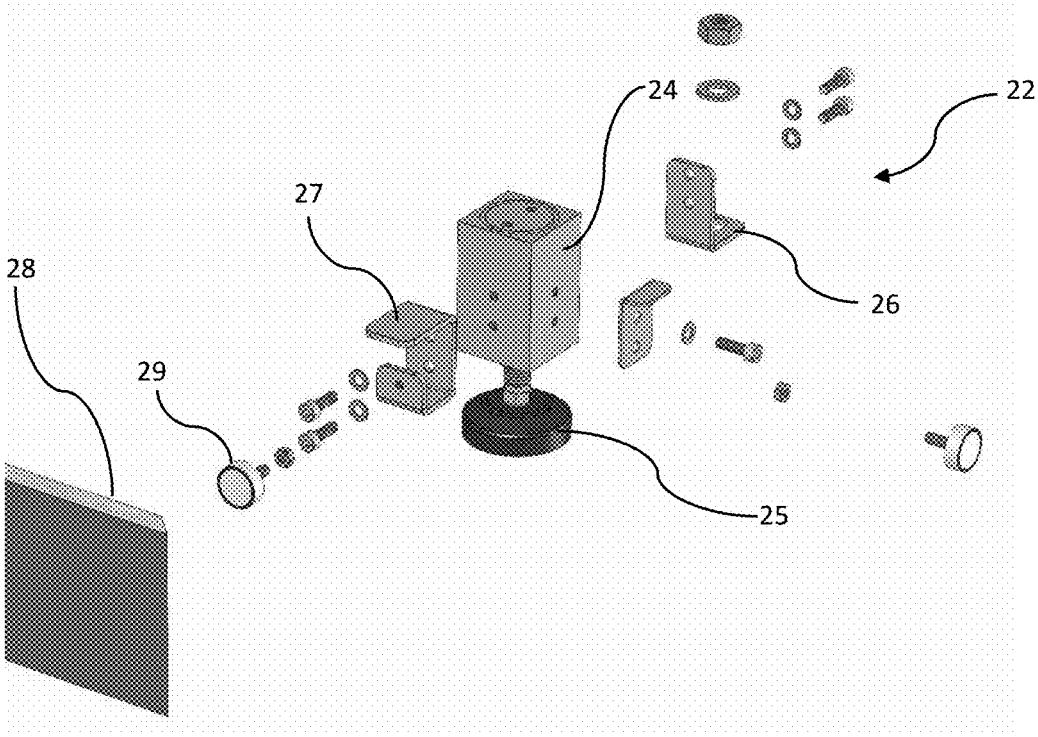
FIG. 12 shows an exploded view of the foot of FIG. 11.
Figure 13:
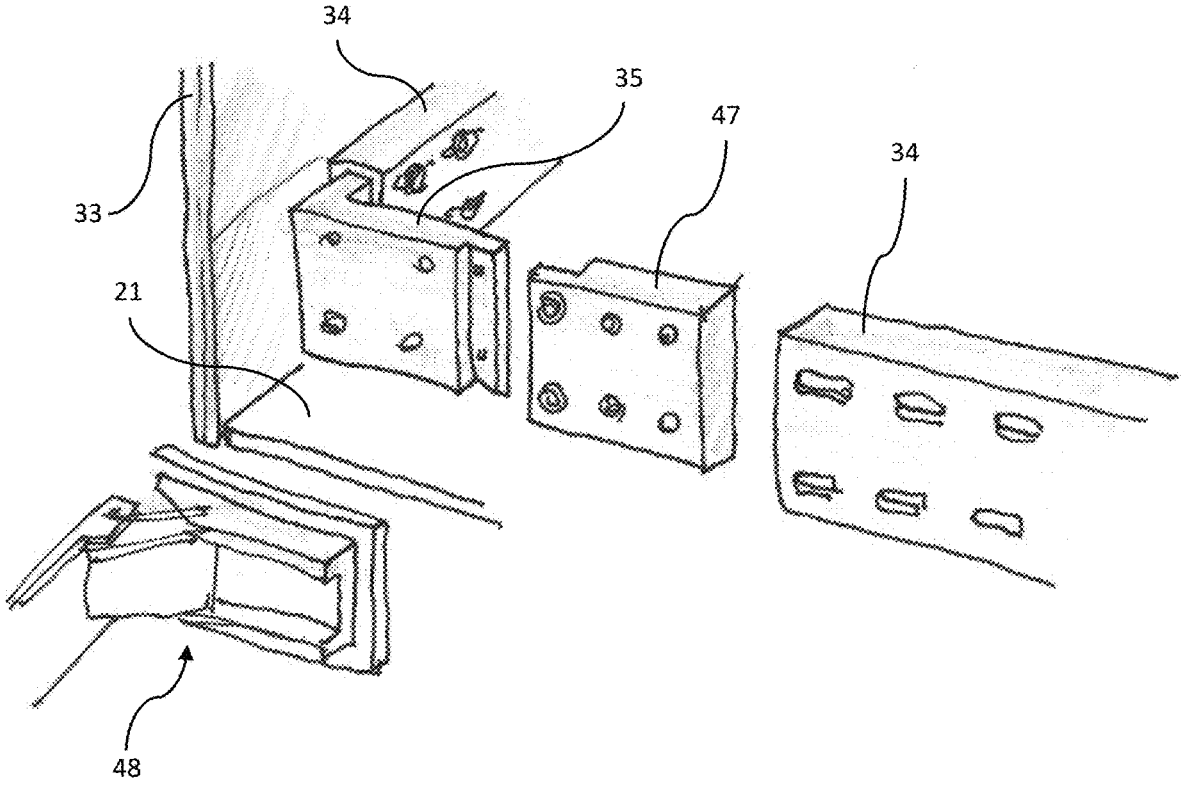
FIG. 13 shows a variant of the detail of FIG. 9.
Figure 14:
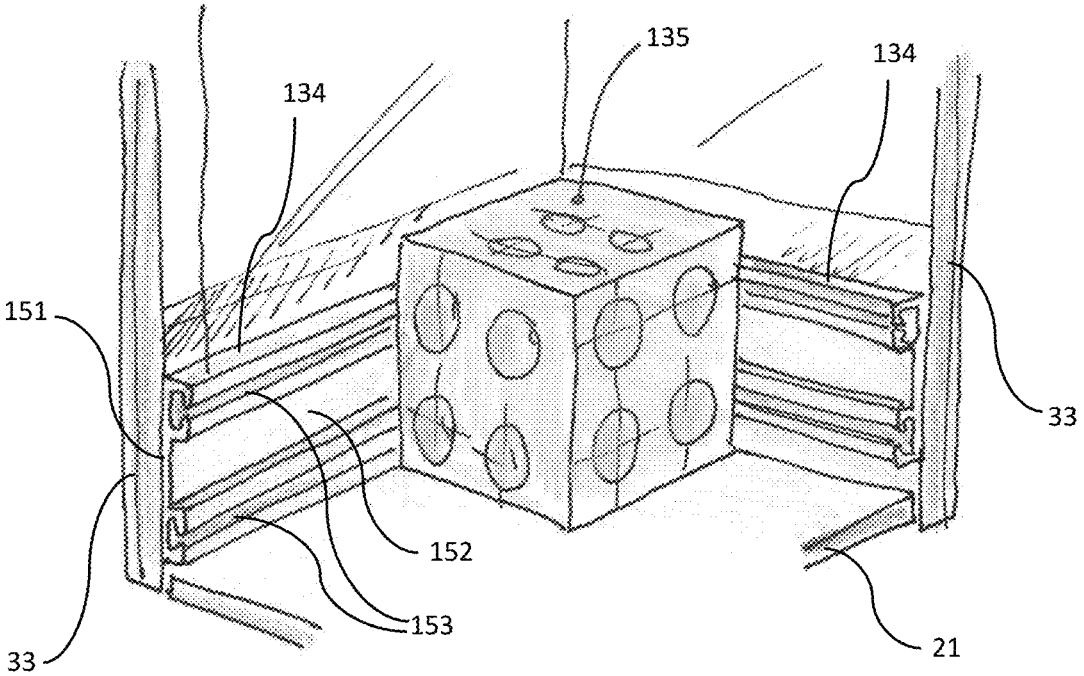
FIG. 14 shows—similar to FIG. 6—a part of a variant of the display case of FIG. 1.
Figure 15:
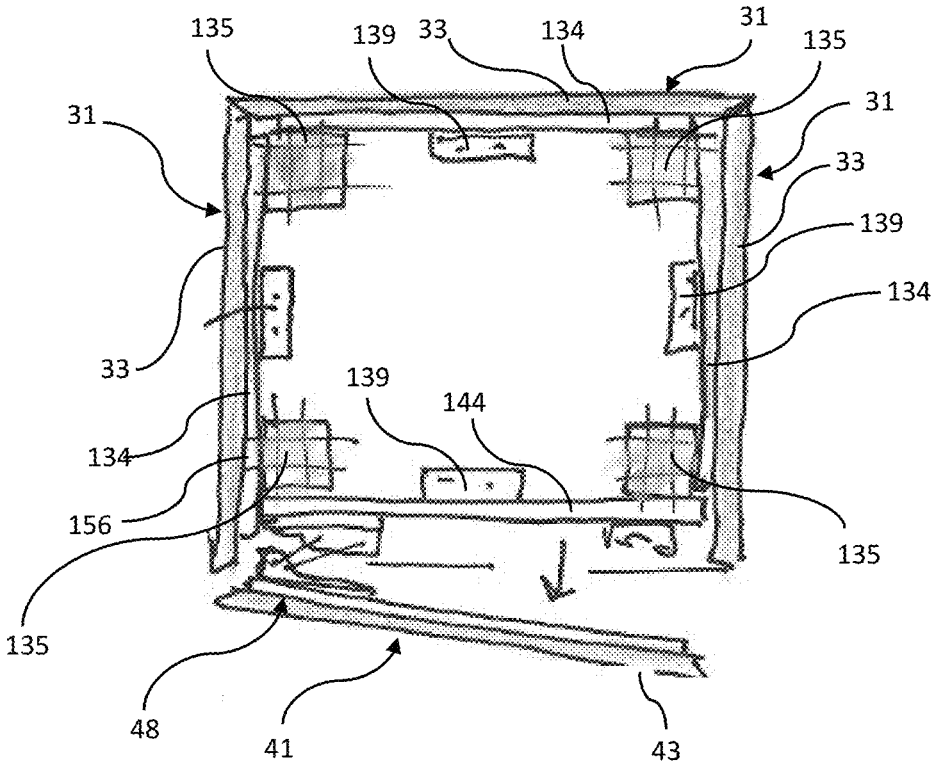
FIG. 15 shows—similar to FIG. 10—the mounting of the display case variant of FIG. 14.
Figure 16:
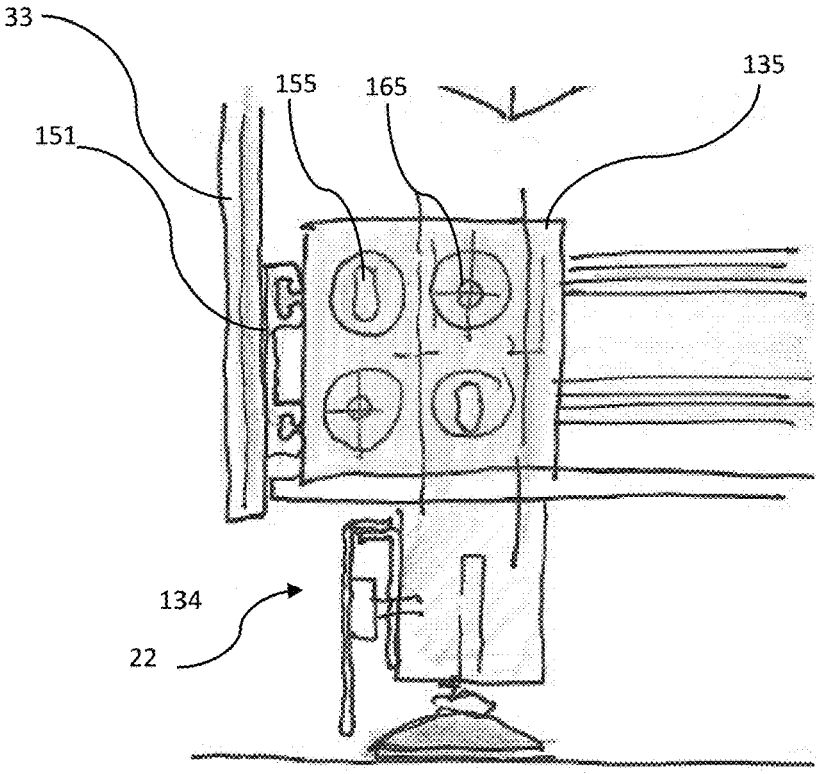
FIG. 16 shows—similar to FIG. 11—a detail with a foot of the platform of the display case variant of FIG. 14.
Figure 17:
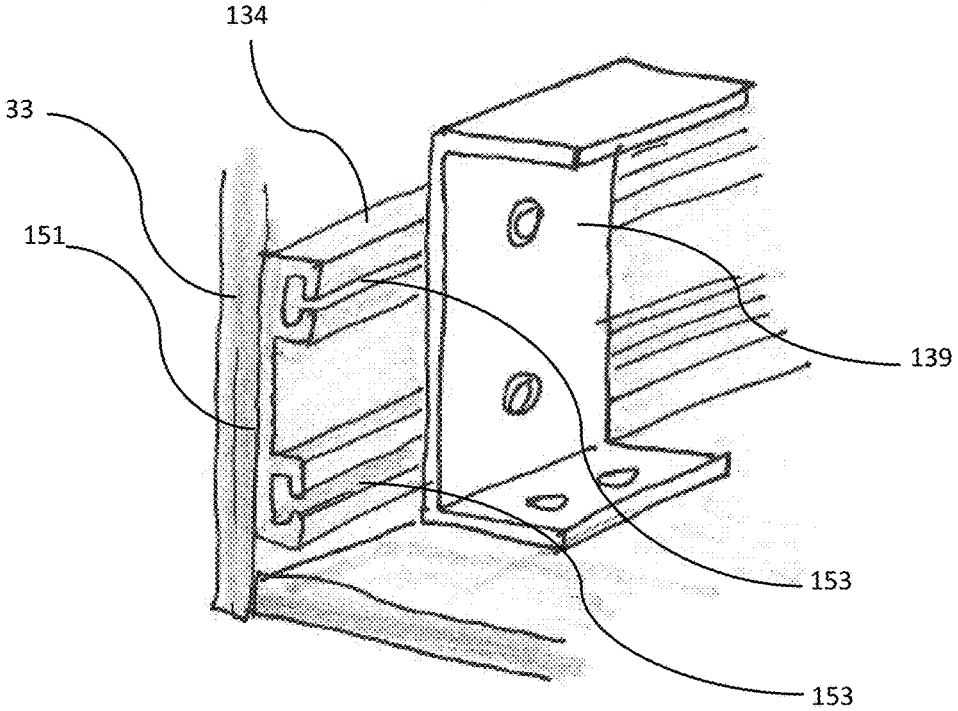
FIG. 17 shows a further detail of the display case variant of FIG. 14.

As can be seen above all in FIG. 9, the opening door 41 is included at one of the sides of display case 10. The opening door 41 comprises an additional glass pane 43, similarly to the wall units 31, but unlike these, it does not comprise any metal beams applied to the additional glass pane 43. On the other hand, at the side of the display case 10 where the opening door 41 is located, the display case 10 comprises a second metal beam 44, having the same shape as the first metal beams 34 of the wall units 31 and connected to the first metal beams 34 of the adjacent wall units 31 by means of the corner joints 35. FIG. 13 shows a variant of the detail in FIG. 9, in which a stiffening extension 47 is applied to the arm of the corner joints 35 grafted in the second metal beam 44, which extension is inserted inside the second metal beam 44.

An opening mounting mechanism 48 is fixed on one side to the additional glass pane 43 of the opening door 41, and to the first metal beam 34 on the other side, at the corner joint 35 and possibly its extension 47. The fixing to the additional glass pane 43 is preferably obtained by gluing, while the fixing to the second metal beam 44 is preferably obtained by screws or the like.

Once assembled in the manner described above, the first and second metal beams 34 and 44, joined by the corner joints 35, form a load-bearing structure of the case 30 of the display case 10. This load-bearing structure (and therewith the entire case 30) is fixed to the plane 21 of the platform 20 by means of brackets 37, fixed with screws or the like on one side to the first or second metal beams 34, 44, on the other side to the plane 21, as shown in FIG. 8.

The display case 10 then comprises a display surface 38, located above the first and second metal beams 34, 44; the display surface 38 closes the display space of the case 30 downwards and can therefore be sealed to the wall units 31 and sealed with respect to the opening door 41 by means of suitable seals, known per se and not illustrated.

The display case 10 also comprises sealing gaskets, between the fixed walls 31 and the opening door 41, as well as closing mechanisms of the opening door 41; all these elements are not shown in the figures, as they are conventional per se.

The display case 10 is constructed as follows.

Firstly, all the necessary parts are prepared, with the desired dimensions; in particular, both the glass panes 33, 43 and the first and second metal beams 34, 44 are made in the desired dimensions. Subsequently, the prepared parts are assembled.

The assembly includes operations to be carried out preferably in the factory and operations to be carried out preferably at the installation site.

The wall units 31 are set up by gluing the first metal beams 34 to the glass panes 33. This is preferably performed in the factory, where it is easier to ensure a perfect gluing.

The opening door 41 is also preferably set up in the factory, gluing the opening mounting mechanisms 48 to the additional glass pane 43.

The successive assembly operations, on the other hand, preferably occur at the installation site of the display case, so that the transport from the factory to the installation site can occur with the display case 10 disassembled. These operations are schematically shown in FIGS. 1 to 5 and 10.

The platform 20 is first partially assembled by mounting the feet 22 below the plane 21.

Above the platform 20, the wall units 31 are then assembled together, constraining the first metal beams 34 together by means of the corner joints 35; at the side of the display case 10 where the opening door 41 is to be located (where there is therefore no wall unit 31 and therefore no first metal beam 34), two second metal beams 44 are placed, extended along that side of the display case both at the bottom and at the top. See the diagrams in FIGS. 1 and 2. If necessary, the joints 35 that are to be coupled to the beams 44 are fitted with the extensions 47, which will provide an internal reinforcement of the second metal beams 44 where the opening mounting mechanisms 48 will be fixed. The extensions 47 can be fixed to the corner joints 35 (e.g., by screws), both to give greater strength to the set, and to allow for easier disassembly of the display case: in fact, if not fixed to the corner joints 35, the extensions 47 would be completely inside the second metal beams 44 and therefore difficult to remove in the event of disassembly.

Once the fixing of the first and second metal beams 34, 44 by means of the joints 35 has been completed, a solid load-bearing structure has been formed, precisely by the first and second metal beams 34, 44 and the corner joints 35, and the glass panes 33 of the fixed side walls 31 of the display case 10 are already associated with such a load-bearing structure. The ceiling 32 is applied above this structure (see FIG. 3). In practice, the case 30 of the display case is thus already formed, which can then be fixed to the platform 20 by screwing the brackets 37 to the first and second metal beams 34, 44 and to the plane 21.

Figure 4:
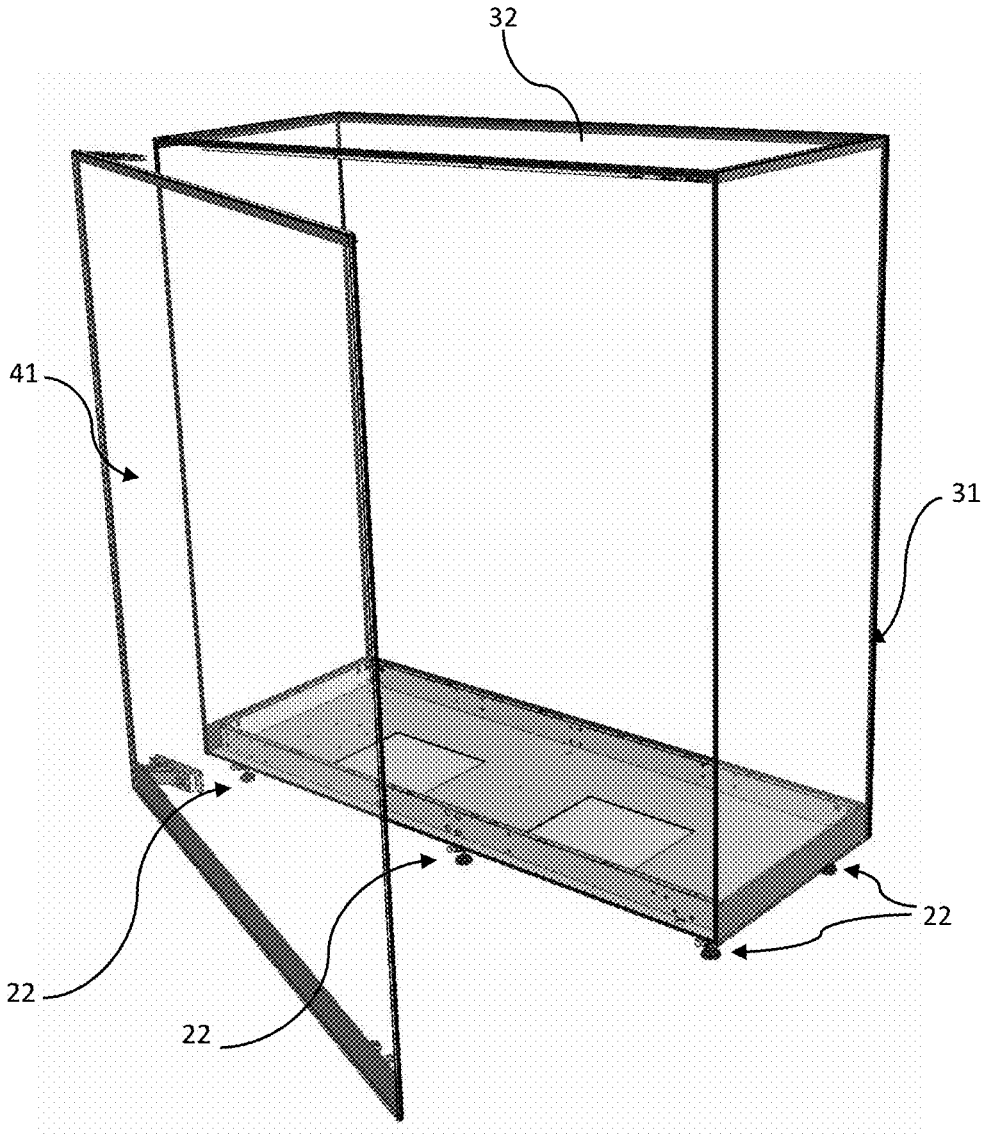

The next step is mounting the opening door 41, FIG. 4, which is carried out by fixing (e.g., by screws) the opening mounting mechanisms 48 to the load-bearing structure, more precisely to the second metal beams 44 at the corner joints 35 and any extensions 47. It should be noted this fixing with screws also contributes to reinforcing the constraint between the second metal beams 44 and the corner joints 35.

Figure 5:
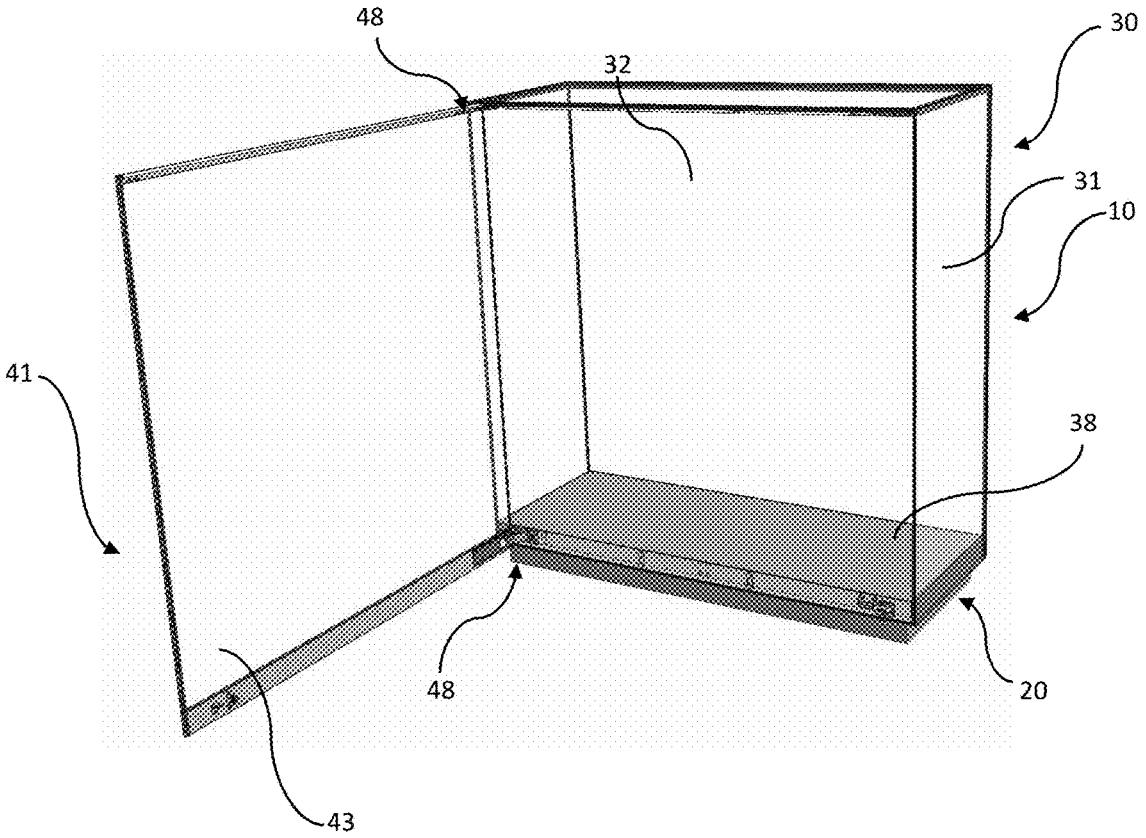

Finally, FIG. 5, the display surface 38 and plinth 28 are mounted.

In the assembly operations just described, the necessary gaskets are also placed between the wall units 31, the opening door 41, the display surface 38 and the ceiling 32.

As can be seen from the above, assembly at the installation site requires only mechanical fixings (with screws or similar) and no gluing between metal and glass parts. As mentioned, this greatly facilitates assembly, ensuring short assembly times and high final quality.

In FIGS. 13 to 16, a variant of the display case described so far is shown. In this variant, different first and second metal beams 134, 144 and corner joints 135 are used; otherwise, the display case (and its mounting method) remain unchanged and will not be described again here. In FIGS. 13 to 16, the same numerical references are used for the elements that are no different from those in the display case 10 illustrated in FIGS. 1 to 12.

As can be seen above all in FIG. 13, the first and second metal beams 134, 144 do not have a tubular structure, but are metal profiles with a substantially flat rear face 151 glued to the glass pane 33, and a free front face 152 on which two open longitudinal channels 153 are formed.

The corner joints 135 are formed by cube-shaped elements, which are fixed to the first and second metal beams 134, 144 by fixing screws 154. The fixing screws 154 are inserted in through holes 155, with slotted cross-section, formed in the cube-shaped corner joints 135, two for each face of the corner joint 135; the fixing screws 154 engage in threaded nuts 156, inserted in the channels 153 of the first metal beams 134. The slotted cross-section of the through-holes 155, as well as the possibility of the threaded nuts 156 to be positioned in any longitudinal position in the channels 153, facilitate the engagement of the fixing screws 154 with the threaded nuts 156, even in the presence of small dimensional imperfections.

In the cube-shaped corner joints 135, alongside and parallel to the through holes 164, threaded holes 165 are also formed, also through and two in number on each face of the corner joint 135; in these threaded holes 165, adjusting screws 164 are inserted engaged, which pointedly abut against the first metal beams 134. By screwing these adjusting screws 164 more or less into the respective threaded holes 165, the position of the corner joints 135 can be adjusted with respect to the first metal beams 134.

Abutments 139 can be advantageously fixed to the first metal beams 134 (by means of screws and nuts inserted in the channels 153) to help support and fix the display surface 38.

The construction method of the display case 10 remains essentially unchanged also according to the variant in FIGS. 13 to 16; clearly, only the manner in which the corner joints 135 are fixed changes. The advantages of easy assembly at the installation site of the display case remain unchanged.

The invention claimed is:

1. A method for constructing a museum display case comprising a platform and a case above the platform, the case having at least one opening door, the method comprising:

applying first metal beams comprising a tubular structure to glass panes by gluing, forming wall units;

providing second metal beams comprising a tubular structure at the at least one opening door;

providing L-shaped corner joints, each L-shaped corner joint having only two arms;

forming the case by assembling the wall units together by the first metal beams, the second metal beams, and the L-shaped corner joints, wherein the first metal beams applied by gluing to the glass panes and the second metal beams provided at the at least one opening door are fixed together by the L-shaped corner joints to form together a load-bearing structure, and wherein the first and second metal beams are solely horizontally arranged along the glass panes;

applying a ceiling to the load-bearing structure after the load-bearing structure has been formed by the first metal beams, the second metal beams, and the L-shaped corner joints; and fixing the load-bearing structure to the platform.

2. The method according to claim 1, wherein applying the first metal beams to the glass panes comprises attaching the first metal beams to the glass panes at or near sides of the glass panes.

3. The method according to claim 1, further comprising, after the forming of the case:

providing at least one additional glass pane; and mounting the additional glass pane in the case by opening mounting mechanisms, fixed to the load-bearing structure on one side and to the additional glass pane on another side, thus forming the at least one opening door.

4. The method according to claim 1, wherein the applying comprises applying the first metal beams to the glass panes by gluing at lower and upper sides of the glass panes.

5. The method according to claim 1, further comprising inserting the L-shaped corner joints into ends of the first and second metal beams.

* * * * *